US005381071A

United States Patent [19]

Zhu

[11] Patent Number: 5,381,071

[45] Date of Patent: Jan. 10, 1995

[54] LAMP BASE FOR A POSITION DEPENDENT LAMP UTILIZING A WINGED POSITIONING PIN

[75] Inventor: Huiling Zhu, Manchester, N.H.

[73] Assignee: Osram Sylvania Inc., Danvers, Mass.

[21] Appl. No.: 226,794

[22] Filed: Apr. 12, 1994

[51] Int. Cl.[6] ..... H01J 5/48

[52] U.S. Cl. ..... 313/318; 313/315; 313/331; 439/226; 439/242; 439/638; 439/642; 439/643

[58] Field of Search ..... 313/318, 331, 315; 439/226, 242, 638, 642, 643, 644, 650

[56] References Cited

U.S. PATENT DOCUMENTS 3,356,984 1/1965 Thorington et al. ..... 313/318
4,496,874 1/1985 Sanders et al. ..... 313/318
4,536,676 8/1985 Maruyama et al. ..... 313/318
4,565,944 1/1986 Beurskens et al. ..... 313/318
4,687,453 8/1987 Lekebusch et al. ..... 313/318

*Primary Examiner*—Donald J. Yusko
*Assistant Examiner*—Ali Horri
*Attorney, Agent, or Firm*—William H. McNeill

[57] ABSTRACT

A base for a position-dependent lamp comprises an inner shell, an outer shell, an aperture in said outer shell, and a hollow pin projecting from said aperture, said pin having a substantially tubular body with a pair of oppositely disposed wings extending from an end thereof, said wings having a length about two and one half to three times the height of said body and being sandwiched between said inner shell and said outer shell. The extended wings add stability to the pin and eliminate the use of lead-based solder in the lamp manufacture.

5 Claims, 3 Drawing Sheets

LAMP BASE FOR A POSITION DEPENDENT LAMP UTILIZING A WINGED POSITIONING PIN

TECHNICAL FIELD

This invention relates generally to lamp bases and more particularly to bases for position-dependent lamps

BACKGROUND ART

Certain types of discharge lamps require a particular orientation for the lamp to achieve proper operation. Such lamps are shown, for example, in U.S. Pat. No. 3,858,078, wherein the lamp has an arched arc tube; and U.S. Pat. No. 4,990,819, wherein the arc tube is mounted skewed relative to the longitudinal axis. These lamps employ bases that may have an index pin projecting from the base to cooperate with a socket to maintain the lamp in the proper orientation.

In the past it has been the practice to weld or solder the pin in place prior to assembly to the lamp. Welding is an expensive operation and soldering requires the usually brass base to be nickel-plated to cover the discoloration resulting from the soldering operation. Additionally, the use of lead-bearing solders can be an environmental hazard and the use of silver solders is too expensive.

DISCLOSURE OF THE INVENTION

It is. therefore, an object of this invention to obviate the disadvantages of the prior art.

It is another object of the invention to enhance the manufacture of lamp types requiring a position-dependent base.

These objects are accomplished, in one aspect of the invention, by the provision of a base for a position-dependent lamp which base comprises an inner shell and an outer shell. An aperture in the outer shell has a hollow pin projecting therefrom. The pin has a substantially tubular body with a pair of oppositely disposed wings extending from an end thereof. The wings have a length about three times the height of the body and are sandwiched between the inner shell and the outer shell. The long wings prevent the body from misalignment and keep its longitudinal axis substantially normal to the longitudinal axis of the lamp. Clamping the wings between the inner and outer shell eliminates the need for soldering (and, thus, the need for nickel-plating the brass shell) and also avoids the cost associated with welding.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
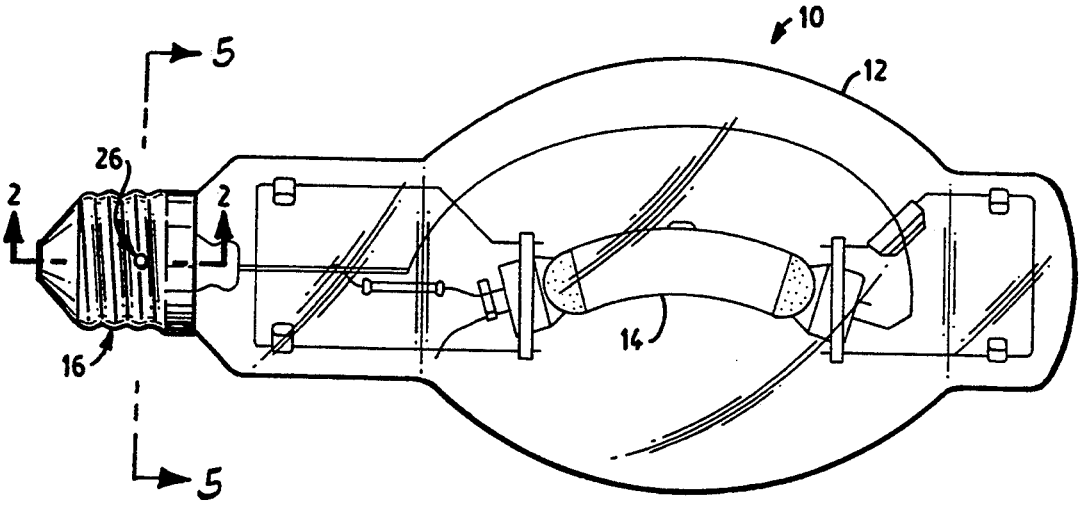
FIG. 1 is an elevational view of a lamp utilizing the invention.
Figure 5:
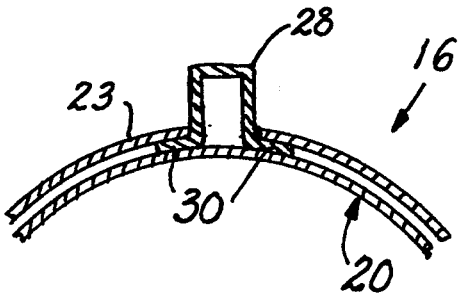
FIG. 5 is a sectional view taken along the line 5—5 of FIG. 1.

Referring now to the drawings with greater particularity, there is shown in FIG. 1 a lamp 10 having an envelope 12 containing a curved or bowed arc tube 14. The lamp terminates in a base 16.

The base 16 has an inner shell 18, (see FIG. 2) which can be aluminum, and which has a first portion (not shown) for engaging the sealed end of the lamp envelope, and a second portion 20 which is threaded. An outer shell 22 which can be and preferably is brass, has a threaded section 23 with treads matching those on the inner shell. An aperture 24 is provided in the outer shell on the crest of one of the threads.

Figure 2:
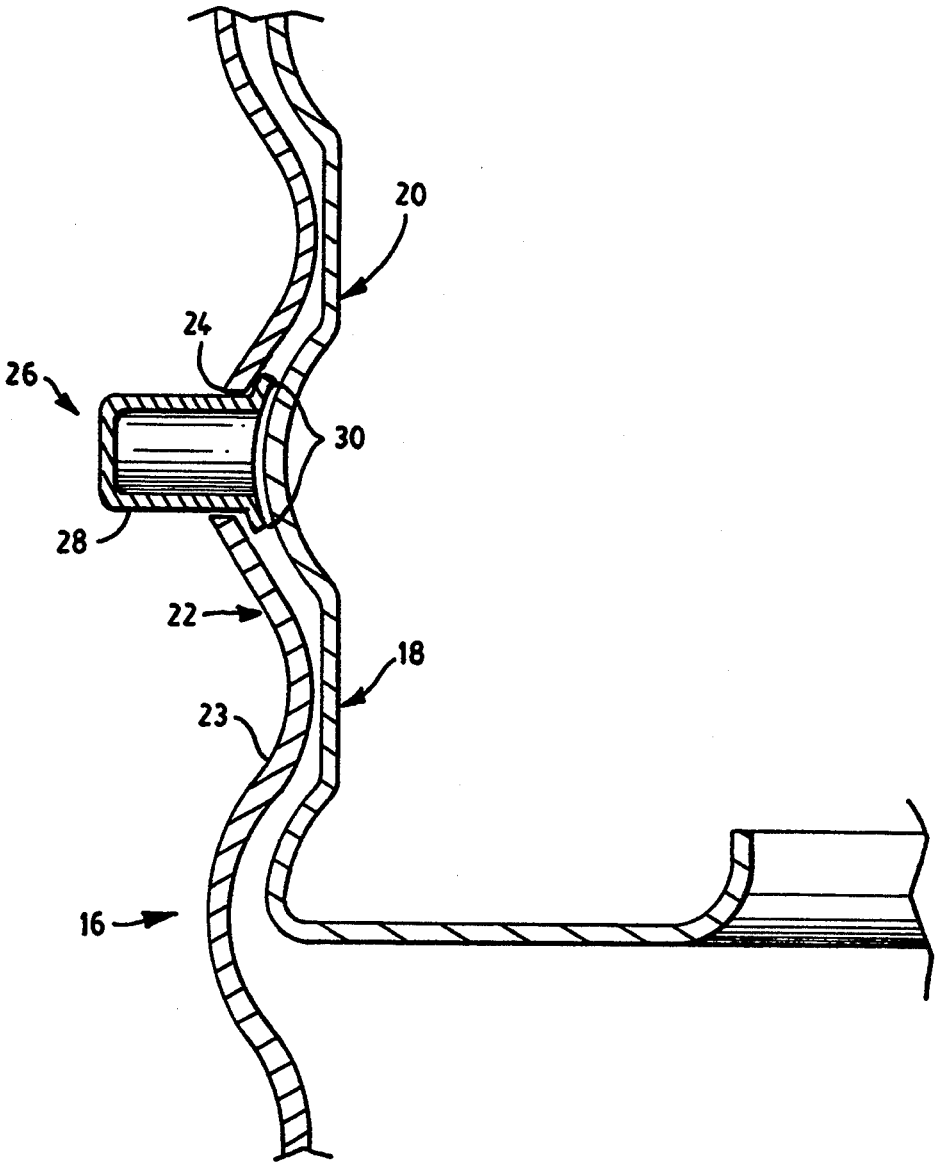
FIG. 2 is a sectional view taken along the line 2—2 of FIG. 1.
Figure 4:
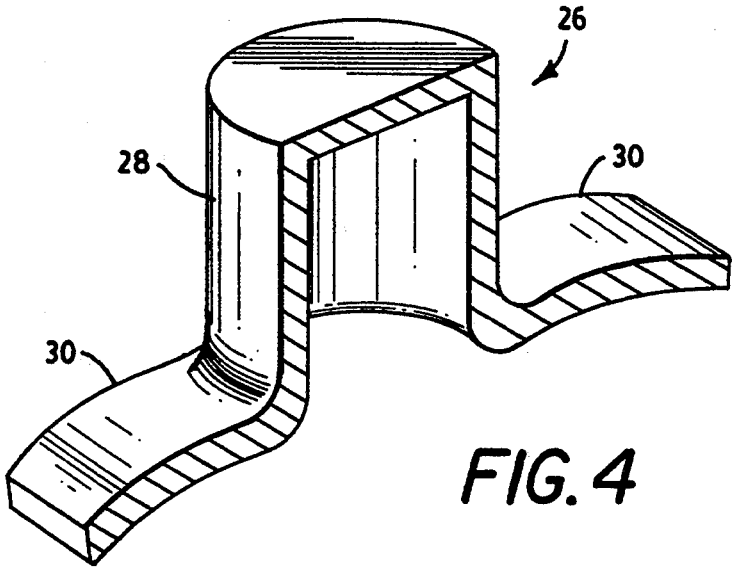
FIG. 4 is a similar view of a second embodiment of a pin for use with the invention.

A hollow pin 26 projects from the aperture. Pin 26 has a substantially tubular body 28 which has a pair of wings 30 oppositely disposed and extending from an end of the body 28. The wings have a total length that is approximately two and one half to three times the height of the body 28. As shown in FIGS. 2 and 4, the wings 30 can be curved in two directions, one to match the curvature of the thread and one to match the circumference.

In a practical embodiment, the wings can have a total length of 0.375" (0.9525 cm), a width of 0.125" (0.3175 cm), and an overall height of 0.150" (0.381 cm). The body can have a diameter of 0.093" (0.236 cm) and the pin can be fabricated from sheet metal such as stainless steel or brass having a thickness of 0.011" (0.02794 cm). Preferably, the pin is formed in a deep drawing operation.

While the pin 26 can be friction fitted into aperture 24, it is convenient to employ a drop of glue to hold the pin in position prior to assembly with the inner shell.

Figure 3:
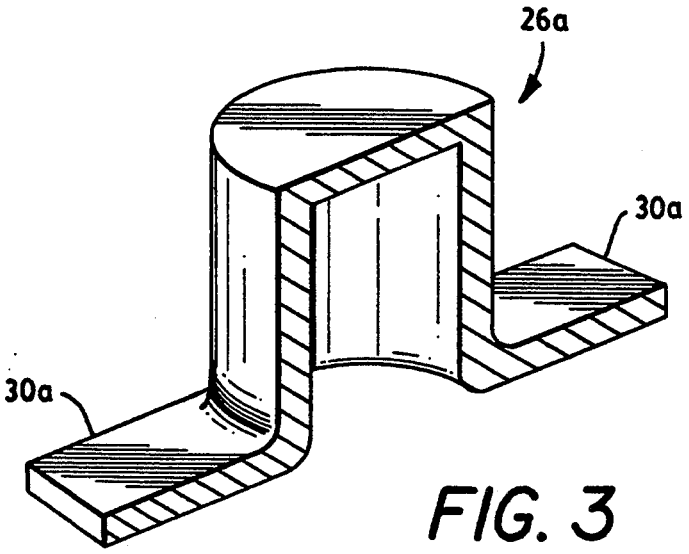
FIG. 3 is perspective, sectional view of a first embodiment of a pin for use with the invention.

In an alternate embodiment, a pin **26*a* can be formed as shown in FIG. 3 wherein the wings 30*a*** are planar.

Thus, it will be seen that employment of this invention reduces the costs associated with position-dependent lamps and the use of lead-based solder is avoided, as is the concomitant nickel-plating of the bases.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A base for a position-dependent lamp comprising: an inner shell; an outer shell; an aperture in said outer shell; and a hollow pin projecting from said aperture, said pin having a substantially tubular body with a pair of oppositely disposed wings extending from an end thereof, said wings having a length about two and one half to three times the height of said body and being sandwiched between said inner shell and said outer shell.

2. The base of claim 1 wherein said inner shell has a first end formed to engage an end of a lamp envelope.

3. The base of claim 2 wherein said inner shell has a second end whose surface is threaded.

4. The base of claim 3 wherein said outer shell is threaded and is screwed upon said inner shell.

5. The base of claim 4 wherein said wings are curved in two directions to substantially match the curvature of said inner and outer shells.

* * * * *